United States Patent [19]

Mathieu

[11] 3,964,184

[45] June 22, 1976

[54] METHOD OF REMOVING MATERIAL FROM A BED OF A BODY OF WATER

[76] Inventor: Thomas A. Mathieu, 2204 Justice, Office A, Monroe, La. 71201

[22] Filed: Apr. 21, 1975

[21] Appl. No.: 569,924

Related U.S. Application Data

[62] Division of Ser. No. 373,140, June 25, 1973, Pat. No. 3,885,331.

[52] U.S. Cl. ..... 37/195; 37/63; 37/78; 114/151; 115/12 R

[51] Int. Cl.[2] ..... E02F 3/88; B63H 11/04

[58] Field of Search ..... 37/195, 78, 62, 63, 37/58; 114/151; 115/12 R, 12 A

[56] References Cited

UNITED STATES PATENTS

| | | | |
|---|---|---|---|
| 119,363 | 9/1871 | Jackson | 114/151 X |
| 184,998 | 12/1876 | Tassey | 37/78 |
| 512,591 | 1/1894 | Walker | 115/12 R |
| 803,587 | 11/1905 | Hanford | 37/63 X |
| 1,240,932 | 9/1917 | Brown et al. | 37/63 UX |
| 1,518,528 | 12/1924 | Libby | 37/62 |
| 2,852,868 | 9/1958 | Talbott et al. | 37/78 |
| 3,013,395 | 12/1961 | Gaylord | 37/62 X |
| 3,599,354 | 8/1971 | Larson | 37/78 |

*Primary Examiner*—Clifford D. Crowder
*Attorney, Agent, or Firm*—Diller, Brown, Ramik & Wight

[57] ABSTRACT

A novel method of removing material from the bed of a pond, lake or like body of water utilizing a floating hull having a bow and stern by drawing water from the body of water at a point closely adjacent the hull, forming the drawn water into a plurality of generally parallel pressurized streams inclined to the horizontal directed rearwardly from the stern, releasing the pressurized streams in the body of water at points substantially removed and generally equidistant from the hull and adjacent the material thereby creating a material-water admixture and simultaneously propelling the hull in a forward bow leading direction, withdrawing the material-water admixture from the body of water, and additionally forming the drawn water into two additional pressurized streams which are selectively released in the body of water at points sidewise removed from the hull adjacent the bow and below the water surface for steering the hull during its forward stern-leading motion.

10 Claims, 4 Drawing Figures

METHOD OF REMOVING MATERIAL FROM A BED OF A BODY OF WATER

This application is a divisional application of my copending application Ser. No. 373,140 filed June 25, 1973 entitled DREDGING BARGE HAVING DIGGING JETS AND STEERING JETS, and now U.S. Pat. No. 3,885,331.

A primary object of this invention is to provide a novel method of removing material, such as cuttings and barite from bodies of water such as so-called mud pits which are simply ponds, lakes or like bodies of water whose beds are covered by the material which is to be removed. However, since the material is rather dense due to having settled to the bottom, in keeping with the present invention the method includes utilization of a floating hull as a platform from which water is drawn from the body of water, preferably close to its upper surface, the drawn water is formed into a plurality of generally parallel pressurized streams inclined to the horizontal and directed rearwardly from a stern of the hull and released at points substantially removed therefrom and generally equidistant thereto adjacent the material for creating turbulence and admixing the material and water, and thereafter collectively withdrawing the material-water admixture and disposing of the same as necessary.

In keeping with a further object of this invention the method further includes the steps of altering the inclination of the parallel pressurized streams depending upon the position of the material upon the bottom of the body of water and/or its distance from the hull, and furthermore providing steering jets at sides of the hull adjacent the bow for steering purposes.

Yet another object of this invention is to provide a novel method of the type heretofore described including means for adjusting the point at which the water is drawn from the body of water prior to its being formed into pressurized jets.

With the above and other objects in view that will hereinafter appear, the nature of the invention will be more clearly understood by reference to the following detailed description, the appended claimed subject matter, and the several views illustrated in the accompanying drawings.

Figure 1:
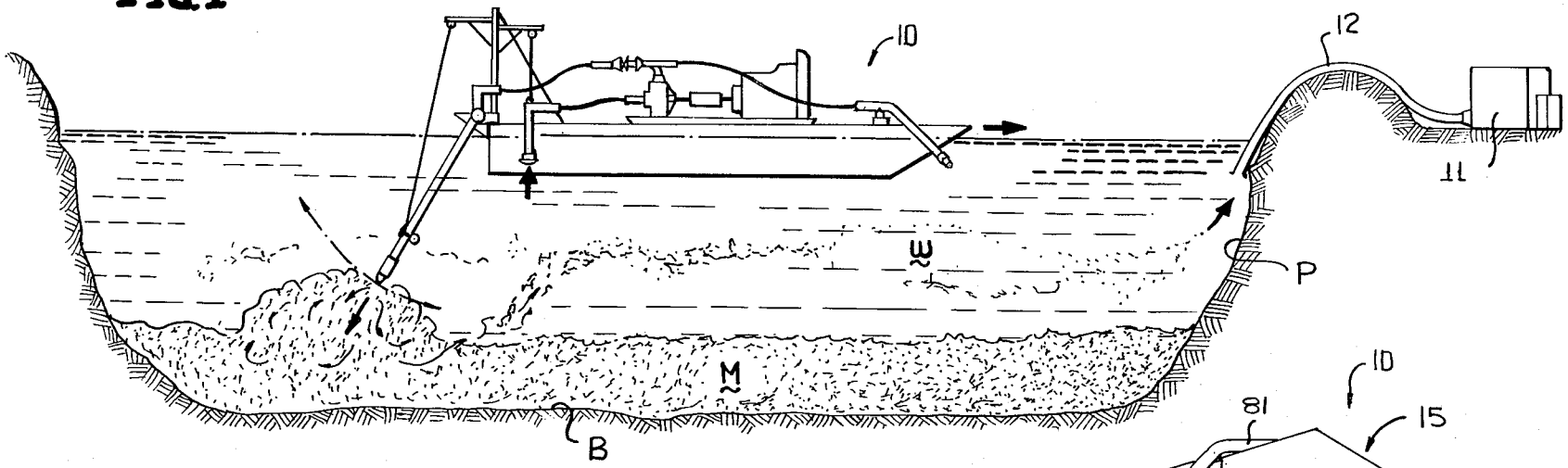
FIG. 1 is a schematic side elevational view of the barge constructed in keeping with this invention, and illustrates the manner in which water is drawn through a pipe and forcefully returned adjacent the upper surface of cuttings, barite, or similar material resting upon the bed of a lake, pond or similar body of water.

Referring first to FIG. 1 of the drawings, a pit P having a body of water W includes upon its bed B material M, such as cuttings, barite, or the like. Due to the settled condition of the material M its removal is extremely difficult, but in accordance with the present invention a barge, generally designated by the reference numeral 10 is provided for creating an admixture of the water W and the material M which can, for example, be thereafter collectively siphoned or pumped from the pit P by any suitable on-shore pump 11 through a conduit 12. The material-water admixture may then be transferred by piping to, for example, a non-producing oil or gas well or a disposal well.

The manner of accomplishing the admixture is that of forcing the particles of material M which have settled out of the water W back into suspension to create a pumpable slurry. To accomplish this goal the upper strata of water W, which is relatively clean initially, is pumped out and redistributed forcefully immediately adjacent the upper surface (unnumbered) of the material M, in a manner to be described more fully hereinafter.

Figure 2:
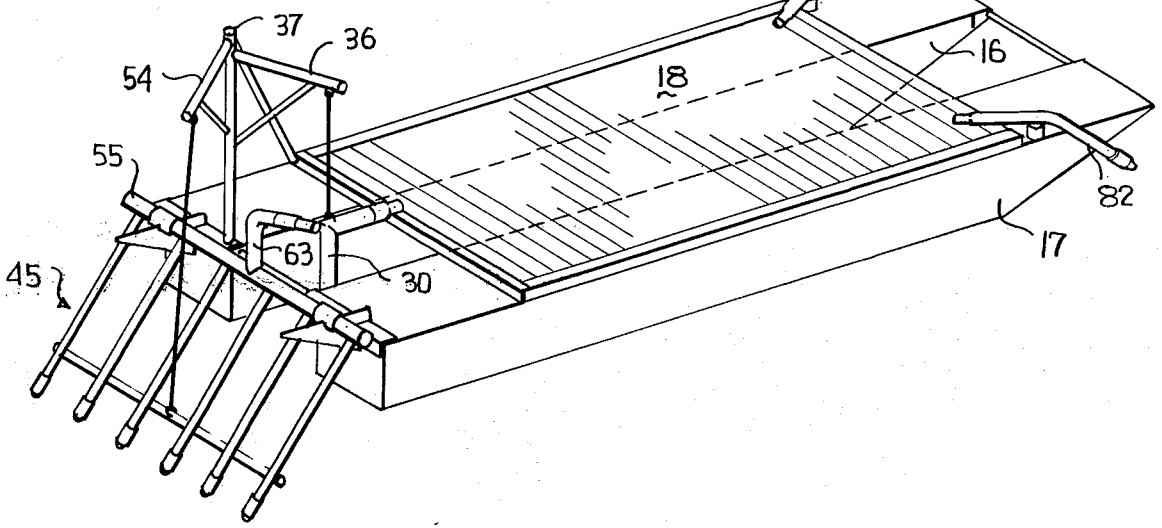
FIG. 2 is an enlarged perspective view of the barge of FIG. 1, and illustrates the major components exclusive of apparatus which has been removed for clarity.
Figure 3:
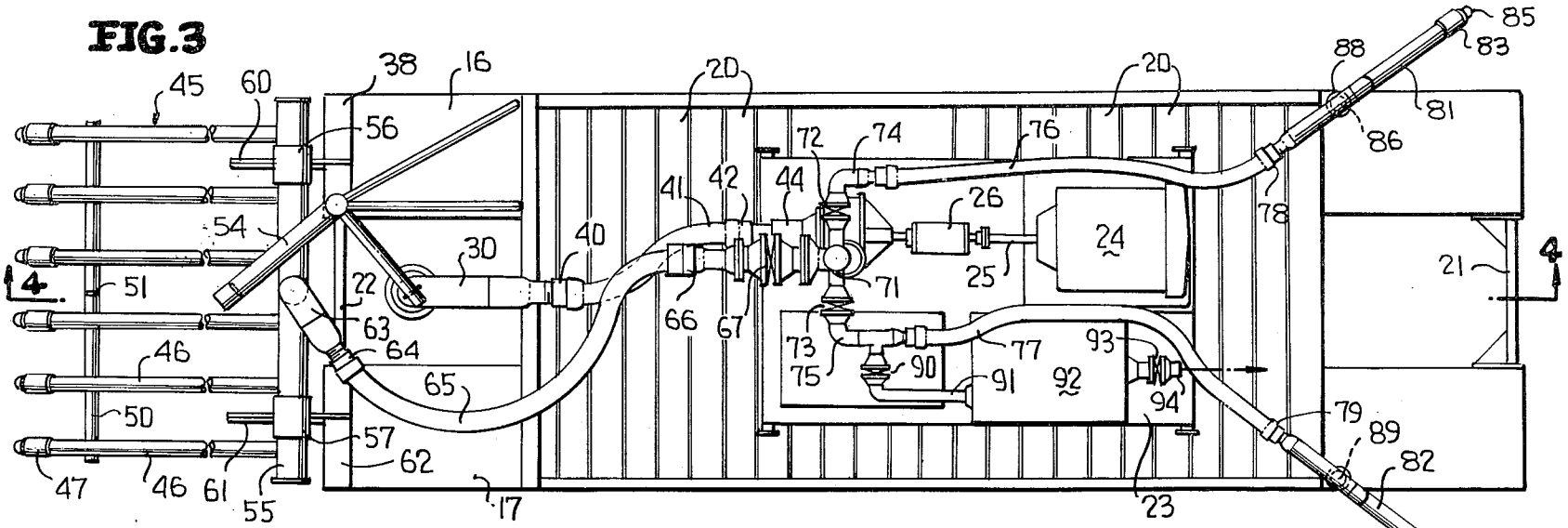
FIG. 3 is a top plan view of the barge of this invention, and illustrates details of the pipes at the bow and stern which are mounted for pivoting motion about respective horizontal and vertical axes.

Referring more particularly to FIGS. 2 and 3 of the drawings, the barge 10 includes a hull 15 formed by a pair of spaced pontoons 16, 17 bridged by a deck 18 which is formed by a plurality of 2-inch thick timber decking planks 20. The pontoons 16, 17 are reinforced at tapered forward ends (unnumbered) thereof by a piece of tubular bridging material 21, as also occurs at the stern by a like bridging tube 22 (FIG. 3). A rigid metallic frame 23 rests atop the decking planks 20 and suitably carried thereby is a prime mover 24 which is preferably a diesel engine having an output shaft 25 connected to a pump 26 having an impeller housing 27 of a conventional construction. The impeller (not shown) is rotated to both draw water W from a point adjacent the surface and by suitable conduit means to be described more fully hereafter returns this drawn water forcefully back into the body of water W adjacent the upper surface of the material M to admix the same with the water and thus produce the pumpable slurry heretofore noted.

Figure 4:
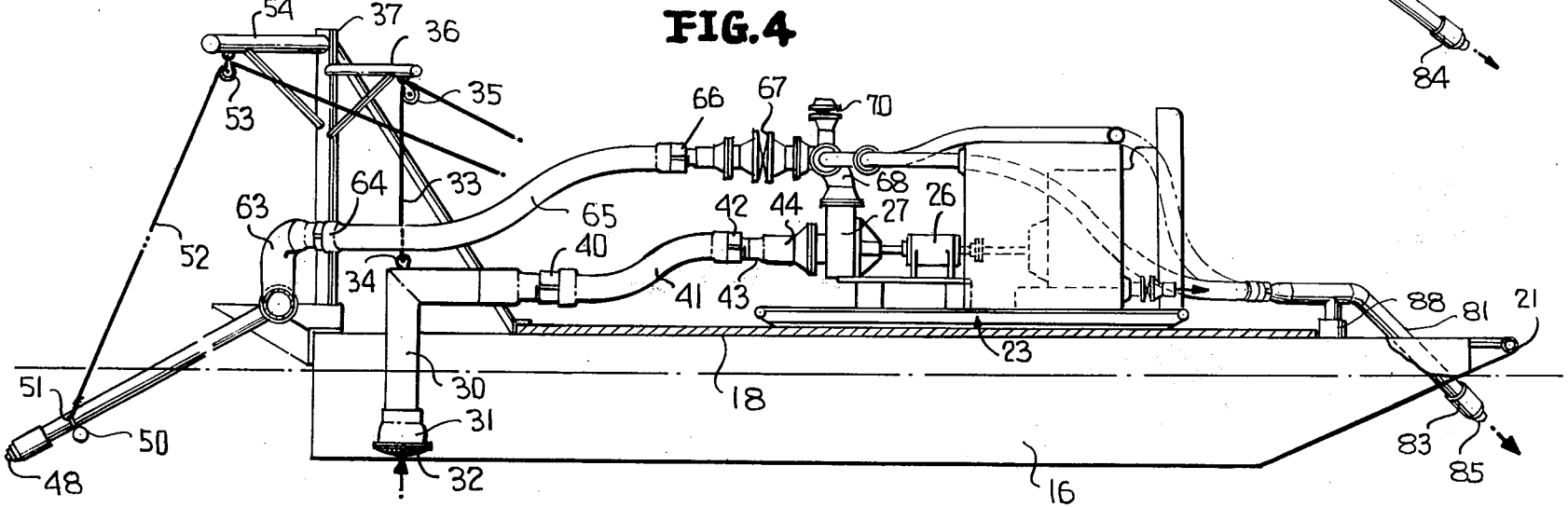
FIG. 4 is a cross-sectional view taken generally along line 4—4 of FIG. 3, and illustrates details of a prime mover, a pump, and suitable controls for the conduits coupled to the various pipes.

A generally L-shaped pipe 30 carries at one end a conventional foot valve 31 and a screen 32. The pipe 30 is illustrated slightly below the surface of the water in FIG. 4 and is held in this position by a cable 33 connected at one end to an eye 34 which is welded to the pipe 30. The cable 33 is partially entrained about a pulley 35 which is in turn connected from an outrigger 36 of a post 37 whose lower end is welded or otherwise secured to a metallic bracket 38 which is in turn welded or bolted to the pontoon 16. The cable 33 is connected to a suitable powered winch and by selective energization of the latter the pipe 30 may be raised or lowered as desired.

The pipe 30 is of a 6 inch diameter and at a reduced end includes a conventional thread to which is attached a coupling 40 of a flexible conduit 41 having another coupling 42 at an opposite end joined to a thread 43 of an inlet pipe 44 in turn joined to the impeller housing 27.

The water drawn from the water through the pipe 30 upon the operation of the pump 26 is forcefully returned by means of a series of tubular jetting pipes collectively indicated by the reference numeral 45. Each pipe 46 of the plurality of pipes 45 has at a lowermost end a collar 47 which reduces the normal 3 inch diameter of each pipe 46 to approximately a ¾ inch outlet opening, generally designated by the reference numeral 48 in FIG. 4. A metallic tube 50 underlies and is welded to each of the tubes 46 and carries an eye 51 to which is secured a cable 52 entrained about a pulley 53 connected to an outrigger 54 which is in turn welded or otherwise secured to the post 37. The cable 52, much in the manner of the cable 33, is secured to a powered winch or the like for changing the degree of inclination of the plurality of pipes 45 in order that the orifices 48 may be positioned at different levels with respect to the upper surface of the material M depending, of course, upon the height of the material M and the depth of the water W.

The ends of the pipes 46 remote from the caps 47 are welded to a tubular manifold or header 55 which is a 6 inch pipe mounted for pivoting movement about a horizontal axis by virtue of 8 inch pipe saddle hinges 56, 57 welded to arms 60, 61 which are in turn welded to the bracket 38 and another bracket 62 welded to the pontoon 17. A 6 inch pipe 63 is welded to the manifold 55 and at a male end is secured a coupling 64 of a flexible conduit 65 having a like coupling 66 remote from the coupling 64. A 6 inch butterfly valve is located in a valve housing 67 and includes an external handle (not shown) for controlling the flow of water from the impeller housing 27 through a conduit 68 into the flexible conduit 65 and eventually outwardly of the orifices 48 of each of the pipes 46. Another butterfly valve (3 inch) 70 is located in a 3 inch generally T-shaped coupling 71 for closing the latter when it is desired to prime the pump or impeller 26, 27. The arms (unnumbered) of the T-coupling 71 include further 3 inch butterfly valves 72, 73 (FIG. 3) each joined by rigid 3 inch tubular elbows 74, 75, respectively, to flexible 3 inch hoses 76, 77.

Opposite ends of the hoses 76, 77 are joined by female couplings 78, 79 to 3 inch tubes or conduits 81, 82 which include end caps 83, 84 each terminating in an orifice 85, again of a generally ¾ inch diameter. The pipes 81, 82 are rigid and have welded thereto vertical posts 86, respectively, which are removably received in upstanding sockets 88, 89 welded or otherwise secured to the respective pontoons 16, 17. The tubes 81 can therefore be swung about the vertical axes as defined by the posts 86, 87 for steering the barge 10 in a manner to be described more fully hereinafter, although it is noted that the pipes are bent downwardly and project below the water line, in the manner best illustrated in FIGS. 1 and 4.

Another butterfly valve 90 is joined to the elbow 75 and is connected by a conduit 91 to a tank 92 which includes a butterfly valve 93 in an outlet conduit 94.

METHOD OF OPERATION

Assuming that the material M is fully settled, a typical operation is begun by launching the barge 10 in the water W of the pit P or, if already launched, priming the impeller housing 27 of the pump 26 by appropriately operating the valve 70. Depending upon the disposition of the barge with respect to the shore line a selected one or more of the valves 72, 73 and 67 are operated to move the barge 10 away from the shore and begin its travel over the entire surface area of the pit P. For example, if the barge 10 is generally parallel to the shore line with the pontoon 17 most immediately adjacent thereto the valve 73 would be opened so that water drawn through the pipe 30 will issue from the orifice 85 of the conduit 82 with sufficient force to swing the right hand end of the barge 10, as viewed in FIG. 3, in a counter-clockwise direction. Thereafter the valve 73 may be closed and the valve 44 opened to redirect the pumped water through the conduit 65, the header 55, and the pipes 46 such that water issuing from the orifices 48 thereof immediately adjacent the upper surface of the material M (FIG. 1) will set up sufficient turbulence to admix and eventually create a pumpable slurry of the material M and the water W. The angle of inclination of the pipes 45 may be varied so that the orifices 48 are immediately adjacent the upper surface of the material M whereas the vertical height of the pipe 30 is maintained just slightly below water level in order that at least initially clearer water is drawn from the upper strata. As is best viewed in FIG. 1, the turbulence created by the water issuing from the orifices 48 also moves the barge forward or to the right as viewed in FIG. 1 with steering being achieved by controlling the flow of water to the valves 72 and/or 73, as well as the disposition of the pipes 81, 82 by virtue of their vertical pivotal mounting. It is also to be noted that upon the closing of the valve 67 with the valves 72, 73 being opened the water issuing from the orifices 85 of the pipes 81, 82 will move the barge 10 from right-to-left as viewed in FIG. 1. Moreover, upon the latter movement turning can be accomplished by the control of the valves 72, 73 and the position of the pipes 81, 82 as can be readily determined simply by manually pivoting the same.

Assuming that the pit P is approximately filled with 80,000 barrels of water it takes approximately 24 hours to admix the water W and the material M into a pumpable slurry. Until the entire water material is admixed no pumping takes place but thereafter the on-shore pumping is energized and the slurry is drawn through the conduit 12 which may be lowered as the slurry level decreases.

At times when the slurry level in the pit P becomes too low to be picked up by the on-shore pump 11 through the conduit 12 the pipe 30 is employed to pump the slurry from the pit and by opening the valves 73, 75 the pumped slurry is admitted into the tank 92 through the conduit 91. Preferably another valve (not shown) is located in the pipe 75 between the valve 90 and the coupling (unnumbered) adjacent thereto to preclude the slurry from being pumped through the conduit when the in-tank loading mode is being practice. The tank 92 may, of course, be subsequently coupled to the conduit 12 and upon opening the valve 93 the contents of the tank 92 may be pumped to a dry well or suitable storage area.

Though variables in equipment are contemplated, in keeping with a preferred form of the invention the pump 26 is a 5 × 6 Mission Centrifugal powered by a 2-71 General Motors Deisel 24. The on-shore pump 11 is a PJ-8 Gardner Denver powered by a Gernal Motors V-871 Diesel.

The water, as earlier mentioned, is picked up relatively particle free during initial operation of the barge 10 and is done so at a rate of 1000 to 5000 gallons per minute at 35 to 75 p.s.i. In actual practice it has been found that tubes corresponding to tubes 46 may be no longer than 12 feet and may vary from two in number for small pits to as many as eight for a very large pit of approximately 150,000 barrels.

The primary key to achieving the turbulence or jetting action of the tubes 46, 81, 82 is the fluid velocity, and not its pressure. Only a given number of particles of the material M per gallon will remain in suspension (slurry) and therefore the more gallons pumped through the jets or tubes 46, 81, 82 the quicker the particles will combine with the water to form the material-water (slurry) admixture. Of course, pressures can be increased with larger or more than a single stage centrifugal pump as in the presently described preferred embodiment of the invention.

While preferred forms and arrangements of parts have been shown in illustrating the method practiced in accordance with the invention, it is to be clearly understood that various changes in details and arrangement of parts and method steps may be made without departing from the scope and spirit of this disclosure.

I claim:

1. A method of removing material from the bed of a pond, lake or like body of water utilizing a floating hull having a bow and stern comprising the steps of drawing water from the body of water at a point closely adjacent the hull, forming the drawn water into a plurality of generally parallel pressurized streams inclined to the horizontal and directed rearwardly from the stern, releasing the pressurized streams in the body of water at points substantially removed and generally equidistant from the hull and adjacent the material thereby creating a material-water admixture and simultaneously propelling the hull in a forward bow-leading direction, changing the distance of the last-mentioned points relative to the hull depending upon the distance of the material from the hull, forming the drawn water into two additional pressurized streams, selectively releasing one or both of the additional pressurized streams in the body of water at points sidewise removed from the hull adjacent the bow and below the water surface for steering the hull during its forward bow-leading motion, selectively moving one or both of the additional streams to move the point or points of impingement thereof with the water along an arc materially outboard of the hull and having a center on said hull medially of sternmost and bowmost points of impingement of each additional stream, and withdrawing the material-water admixture from the body of water.

2. The method as defined in claim 1 wherein said drawing step is performed between sides of the hull.

3. The method as defined in claim 2 including the step of changing the point at which water is drawn from the body of water.

4. The method as defined in claim 1 including the step of changing the point at which water is drawn from the body of water.

5. The method as defined in claim 1 wherein the withdrawing step is performed on the hull.

6. The method as defined in claim 1 wherein the withdrawing step is performed on shore.

7. The method as defined in claim 1 wherein each said center defines a vertical pivot point for its associated additional stream.

8. The method as defined in claim 7 wherein the withdrawing step is performed on the hull.

9. The method as defined in claim 7 wherein the withdrawing step is performed on shore.

10. The method as defined in claim 7 including the step of changing the point at which water is drawn from the body of water.

* * * * *